US007730821B2

(12) United States Patent
Taylor

(10) Patent No.: US 7,730,821 B2
(45) Date of Patent: Jun. 8, 2010

(54) ELECTROMAGNETIC LAUNCHER WITH AUGMENTING BREECH

(75) Inventor: Robert J. Taylor, Ballwin, MO (US)

(73) Assignee: The Boeing Company, Chicago, IL (US)

( * ) Notice: Subject to any disclaimer, the term of this patent is extended or adjusted under 35 U.S.C. 154(b) by 564 days.

(21) Appl. No.: 11/515,173

(22) Filed: Sep. 1, 2006

(65) Prior Publication Data

US 2008/0053299 A1 Mar. 6, 2008

(51) Int. Cl.
*F41F 1/00* (2006.01)

(52) U.S. Cl. ..... 89/8; 89/14.3; 124/3

(58) Field of Classification Search ..... 89/8, 89/28.05, 14.3, 42.03, 42.01; 124/3
See application file for complete search history.

(56) References Cited

U.S. PATENT DOCUMENTS 4,924,750 A * 5/1990 Neugebauer ..... 89/8
5,375,504 A * 12/1994 Bauer ..... 89/8
6,766,793 B2 * 7/2004 MacDougall ..... 124/3

OTHER PUBLICATIONS

Auburn Univeristy ECE Department, "Railgun Theory", http://eng.auburn.edu/department/ece/railgun/theory.htm.

Matthew E. Massey, "Railgun Theory", http://www.matthewmassey.com/RailgunTheory.pdf.

W.A. Walls, W.F. Weldon, S.B. Pratap, M. Palmer, and LT David Adams, USN, "Application of Electromagnetic Guns to Future Naval Platforms", IEEE Transactions on Magnetics, Jan. 1999, pp. 262-267.

LCDR David Adams, USN, "Naval Rail Guns Are Revolutionary", http://edusworld.org/ew/ficheros/2004/railguns.pdf.

Wikipedia, "Railgun", http://en.wikipedia.org/wiki/Railgun.

* cited by examiner

*Primary Examiner*—Stephen M Johnson
*Assistant Examiner*—Daniel J Troy
(74) *Attorney, Agent, or Firm*—Toler Law Group

(57) ABSTRACT

In an exemplary electromagnetic launcher, a housing with breech and muzzle is slidably supported in a carriage supported on a trunnion. First and second electrical contacts are mounted in the carriage toward an axis of the trunnion. The first and second contacts are electrically connectable to receive electrical power from an electrical power supply. First and second augmentation conductors are disposed aft of the trunnion and are electrically connected to the first and second electrical contacts. First and second main conductors extend from the breech toward the muzzle. A current cross-over connection is disposed toward the breech and electrically connects the first and second augmentation conductors with the first and second main conductors, respectively. The first and second electrical contacts and the first and second augmentation conductors may be engaged in slidable electrical contact over a portion of the first and second augmentation conductors, thereby accommodating recoil motion.

23 Claims, 2 Drawing Sheets

ELECTROMAGNETIC LAUNCHER WITH AUGMENTING BREECH

BACKGROUND

An electromagnetic launcher, or railgun, uses very high electrical current (on the order of millions of Amperes) to create an electromagnetic force, or Lorentz force, to accelerate projectiles. A simple rail gun is made of two parallel metal conductor rails (hence the name railgun) that are connected to an electrical power supply.

Electrical current is supplied from a positive terminal of the power supply to one of the conductor rails. The electrical current flows from the conductor rail through an electrically conductive projectile (that serves as an armature) across the bore of the rail gun to the other conductor rail and returns to a negative terminal of the power supply.

The flow of electrical current makes the railgun act like an electromagnet. To that end, a powerful magnetic field is created in the region of the rails up to the position of the projectile. In accordance with the right-hand rule, the created magnetic field circulates around each conductor. Because the electrical current flows in opposite directions along each rail, the net magnetic field between the rails is directed vertically. In combination with the electrical current flowing across the projectile (armature), a Lorentz force is produced which accelerates the projectile along the rails. Other forces acting on the rails attempt to push the rails apart. However, because the rails are firmly mounted, they cannot move. As a result, the projectile is able to slide along the rails away from the end with the power supply.

If a very large power supply (on the order of around a million Amperes of electrical current or so) is used, then the force on the projectile will be tremendous. By the time the projectile leaves the ends of the rails (that is, the muzzle), the projectile can be travelling at speeds on the order of several kilometers per second.

However, practical applications of electromagnetic launchers in the field typically encounter several issues. These issues include: (1) maintaining electrical contact during launcher recoil; (2) providing a fast rise in the launch forces for optimal acceleration profile (especially for rotating machine pulsed power supplies); and (3) providing a balanced assembly to facilitate launcher aiming.

Regarding the first issue, as does a conventional propellant gun, an electromagnetic launcher recoils during a launch event. Recoil forces are usually absorbed by springs and viscous dampers. However, in an electromagnetic launcher, electrical contact for very high electrical current (again, on the order of millions of Amperes) must be maintained during launcher recoil motion.

In the laboratory, electromagnetic launchers may attempt to maintain electrical contact during recoil in a number of ways. For example, stiff mounts may be used to prevent significant motion, massive launchers may be used to minimize motion, a coaxial brush arrangement may be located near the rearmost point of the launcher, and multiple, large coaxial or twisted cables may be used to provide a flexible connection.

The first three approaches are not practical for field applications where launcher mobility and aiming are necessary. Moreover, coaxial or twisted cables require large volumes to achieve adequate flexibility due to the large cable sizes and number of cables required. In addition, coaxial or twisted cables are difficult to cool when multiple launches are required during a short time.

Regarding the second issue, in order to take full advantage of electromagnetic launcher configurations, it is desired that the acceleration profile in the bore be nearly constant. In typical, known railguns, this requires very fast rise times for the current. Such fast rise times are especially difficult to achieve when rotating machines (that is, electrical generators) are used for the pulsed power supply.

In an attempt to achieve higher acceleration levels at lower current levels, augmented electromagnetic launchers have been developed. Augmented electromagnetic launchers reduce the current required to flow through the projectile body by using multiple current conductors in the launcher to augment the magnetic field with which the armature current interacts. Because these augmenting turns have been employed over the full length of the launcher, the need remains for fast current rise to maintain nearly constant acceleration, although the peak current levels needed are reduced. This reduction in current level is achieved at the expense of higher inductance electromagnetic launcher configurations, longer resistive paths for current flow, and higher residual energy stored in the magnetic field after launch. When the projectile exits an electromagnetic launcher, the magnetic field (that has stored residual energy) collapses and current continues to flow. The energy stored in the magnetic field is either dissipated in a large arc or contributes to inefficiency through component heating in a muzzle shunt, even if energy recovery techniques are employed. Because greater energy is stored in an augmented launcher, the losses are correspondingly greater, overall system efficiency is reduced, and cooling requirements are increased.

Augmentation can provide an advantage early in the launch by requiring a less demanding current rise rate for a pulsed power supply. However, the increased overall inductance requires a greater peak energy transfer during the entire launch. Therefore, an overall greater demand is placed upon the pulsed power supply.

Regarding the third issue, conventional propellant guns achieve a center of gravity (CG) closer to the breech than the muzzle because the high pressure following propellant ignition and subsequent lower pressures during launch and blowdown result in a tapered barrel configuration with massive breech assemblies. However, electromagnetic launcher forces are more uniform and do not lend themselves to tapered configurations in simple launchers. As a result, conventional electromagnetic launcher configurations are balanced about the mid-length of the launcher rather than toward the breech. Therefore, in developing a fielded platform difficult trades must be made between trunnion placement, swept volume on the platform interior, and aiming forces.

The foregoing examples of related art and limitations associated therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems and methods which are meant to be exemplary and illustrative, not limiting in scope. In various embodiments, one or more of the problems described above in the Background have been reduced or eliminated, while other embodiments are directed to other improvements.

In a non-limiting, exemplary electromagnetic launcher, an electromagnetic launcher housing has a breech and a muzzle. The housing is slidably supported in a carriage that is supported on a trunnion. First and second electrical contacts are mounted in the carriage toward an axis of the trunnion, and the first and second contacts are electrically connectable to receive electrical power from an electrical power supply. First and second augmentation conductors are disposed aft of the trunnion, and the first and second augmentation conductors are electrically connected to the first and second electrical contacts. First and second main conductors extend from the breech toward the muzzle. A current cross-over connection is disposed toward the breech, and the current cross-over connection electrically connects the first and second augmentation conductors with the first and second main conductors, respectively.

According to an aspect, the first and second electrical contacts and the first and second augmentation conductors may be engaged in slidable electrical contact over a portion of a length of the first and second augmentation conductors. In such a case, recoil motion of the electromagnetic launcher can be accommodated.

According to another aspect, the current cross-over connection may include a first cross-over connector configured to electrically connect the first augmentation conductor and the first main conductor and a second cross-over connector configured to electrically connect the second augmentation conductor and the second main conductor. In such a case, the first and second cross-over connectors may include first and second pluralities of conductor members in which the connectors of the first plurality of connectors are interleaved with the connectors of the second plurality of connectors.

In addition to the exemplary embodiments and aspects described above, further embodiments and aspects will become apparent by reference to the drawings and by study of the following detailed description.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION

Figure 1:
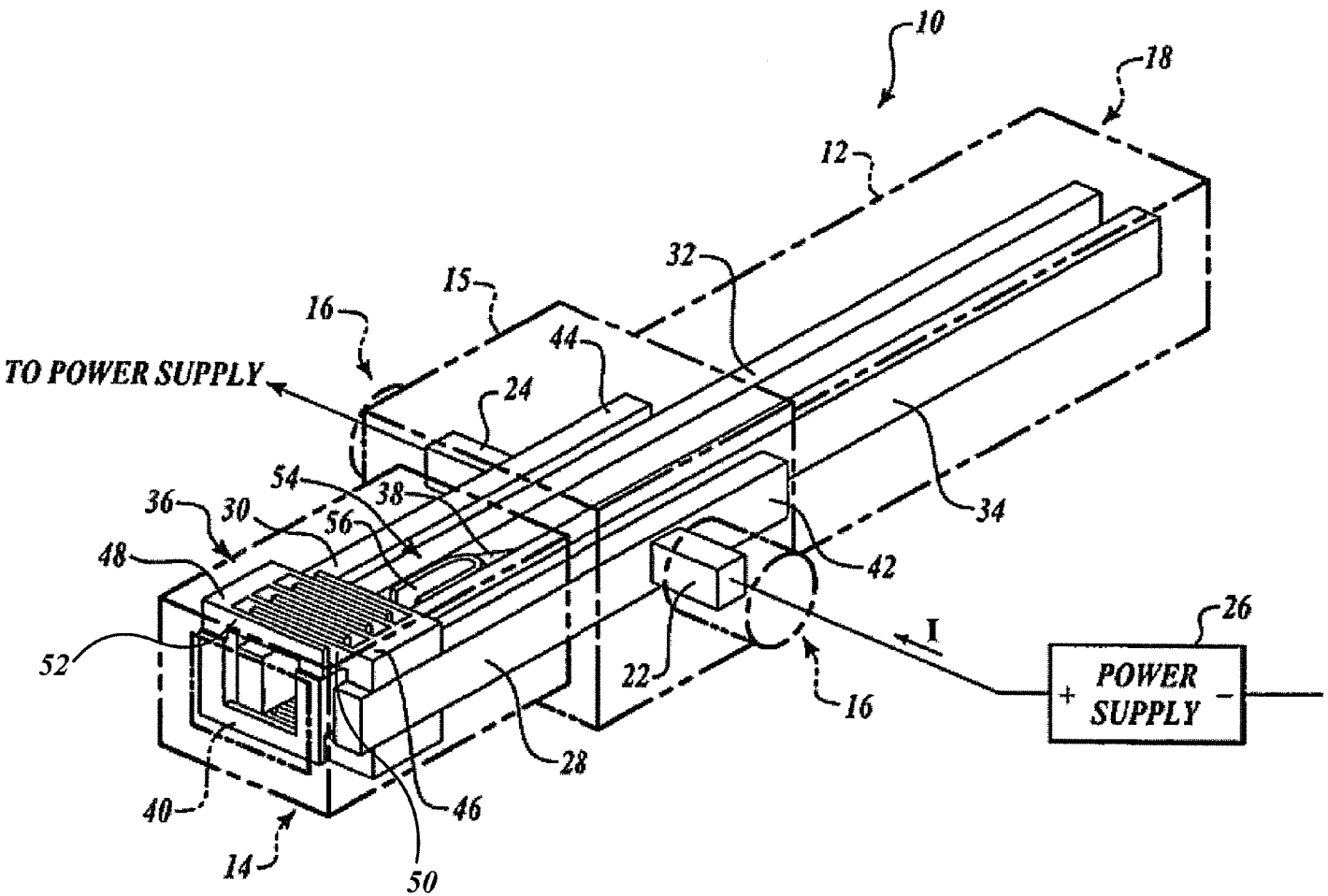
FIG. 1 is a perspective view, partially in schematic form, of an exemplary electromagnetic launcher before a launch event.

By way of overview and referring to FIG. 1, in a non-limiting, exemplary electromagnetic launcher (or railgun) 10, an electromagnetic launcher housing 12 has a breech 14 and a muzzle 18. The housing 12 is slidably supported in a carriage 15 that is supported on a trunnion 16. Electrical contacts 22 and 24 are mounted in the carriage 15 toward an axis of the trunnion 16, and the electrical contacts 22 and 24 are electrically connectable to receive electrical power from an electrical power supply 26. Augmentation conductors 28 and 30 are disposed aft of the trunnion 16, and the augmentation conductors 28 and 30 are electrically connected to the electrical contacts 22 and 24, respectively. Main conductors 32 and 34 extend from the breech 14 toward the muzzle 18. A current cross-over connection 36 is disposed toward the breech 14, and the current cross-over connection 36 electrically connects the augmentation conductors 28 and 30 with the main conductors 32 and 34, respectively. Details of exemplary embodiments will now be set forth below.

The housing 12 may be fabricated from any suitable materials and in any suitable shape to accommodate the electromagnetic launcher 10. Materials used for the housing 12 suitably should be able to withstand high temperatures that arise due to Joule heating and should be able to withstand strong Lorentz forces that attempt to push apart the augmentation conductors 28 and 30 and the main conductors 32 and 34. To that end, the housing 12 suitably may be fabricated from composite materials (such as carbon fiber in a bonding matrix), laminated metal, and electrically insulating structural materials (such as glass or aramid fibers in an epoxy matrix or ceramics). While the housing 12 is shown for the sake of clarity as having a rectangular shape, given by way of non-limiting example the housing 12 may be fabricated in an approximately cylindrical shape (such as a typical shape for a howitzer or a cannon or a naval gun), an elliptical or oval shape, or any shape as desired for a particular application.

Figure 2:
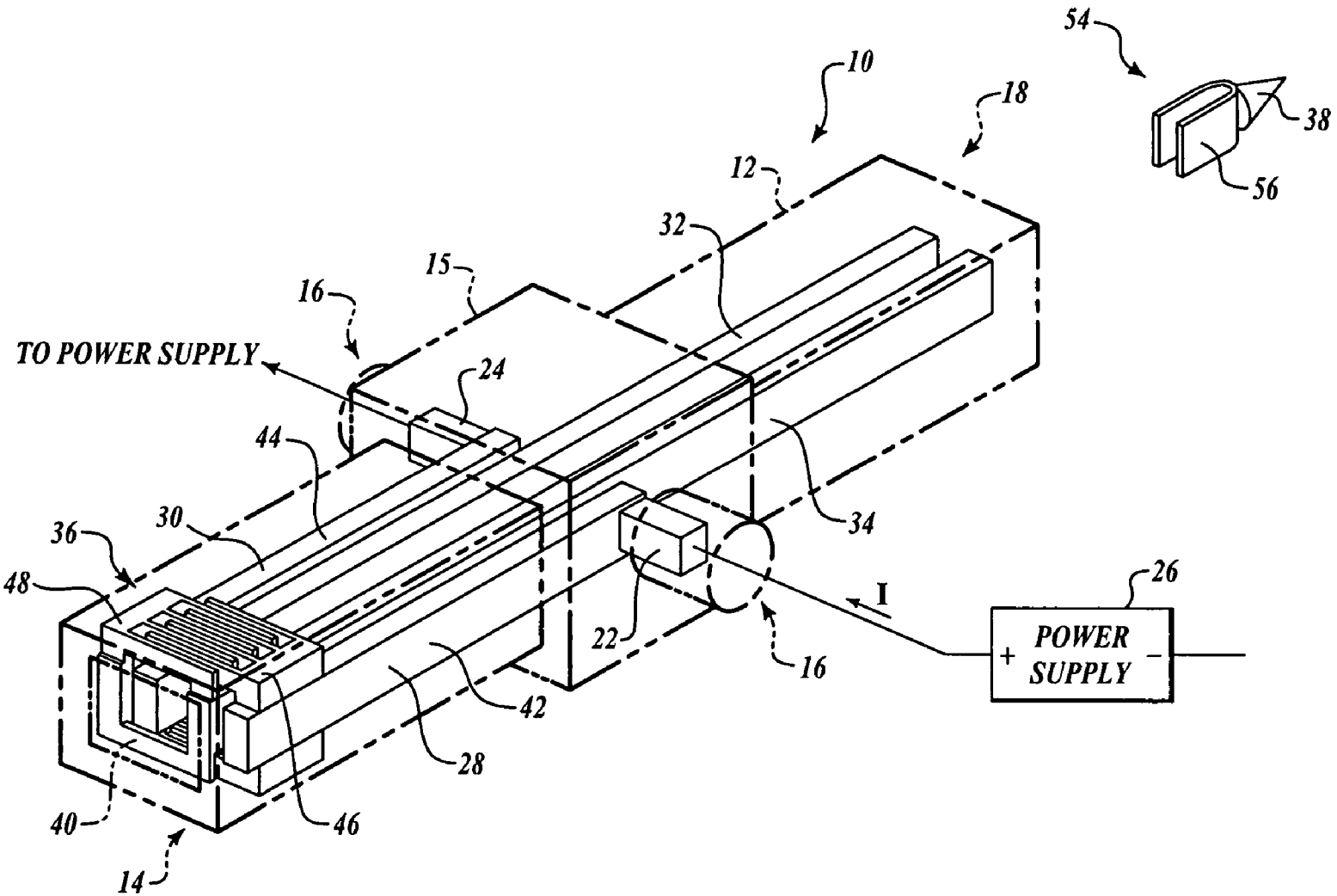
FIG. 2 is a perspective view, partially in schematic form, of the electromagnetic launcher of FIG. 1 after a launch event.

The housing 12 has a length that is long enough to accommodate all of the electrically conducting elements of the launcher and recoils with the electrically conducting elements during a launch event. The housing 12 is slidably supported in a carriage 15. The carriage 15 is supported on the trunnion 16, similar to a conventional gun. Before launch and as shown in FIG. 1, the forward ends of the augmentation conductors 28 and 30 are located forward of the electrical contacts 22 and 24. During the launch event, the reaction forces cause the electrically conducting elements and the launcher housing 12 to slide aft in the carriage 15. Also, the housing 12 exposes a portion of the augmentation conductors 28 and 30 to enable current flow from the electrical contacts 22 and 24. This arrangement permits accommodation of recoil associated with a launch event while maintaining electrical contact. To that end, referring additionally to FIG. 2, after recoil associated with a launch event (as shown in FIG. 2) the electrically conducting components and the housing 12 have slid aft such that the forward ends of the augmentation conductors 28 and 30 are relocated near the forward edge of the electrical contacts 22 and 24.

Regardless of shape of the housing 12, the muzzle is the opening between the main conductors 32 and 34 to accommodate exiting of a projectile 38 from the electromagnetic launcher 10. The breech 14 defines a breech opening 40. The breech 14 may or may not include a breech door (not shown). On configurations which include a breech door, it opens to permit loading the projectile 38 in the electromagnetic launcher 10. If provided, the optional breech door shuts and seals the breech 14 to protect operators during a launch event.

Because of the high currents flowing through the augmentation conductors 28 and 30 and the main conductors 32 and 34 during a launch event, the electromagnetic launcher 10 may be subject to Joule heating. To that end, the housing 12 or the electrically conducting components may incorporate a cooling system (not shown for purpose of clarity), if desired, to cool the housing 12 and the components located inside the housing 12. If provided, the cooling system may permit the electromagnetic launcher 10 to be re-used after a launch event sooner than an instance in which no cooling system is provided. The cooling system may be any suitable cooling system as desired for a particular application. Given by way of non-limiting example, the cooling system may be a passive air cooling system that includes openings (not shown) through which air can enter and circulate through the housing 12. Alternately, the housing 12 may include an active cooling system, such as a forced-air cooling system that includes fans to force air through the housing 12 or electrically conducting components or a liquid cooling system that pumps a cooling fluid, such as water, through channels throughout the housing 12 or the electrically conducting components.

The carriage 15 provides a pivot axis to change the elevation of the electromagnetic launcher 10 for the purposes of aiming. By way of example, the trunnion 16 is shown in FIGS. 1 and 2 as cylindrical projections, but other means may be used as desired. The carriage 15 supports the weight of the electromagnetic launcher 10 as it rests on a mount (not shown for purpose of clarity). The trunnion 16 permits rotating the electromagnetic launcher 10 in elevation, the carriage 15 permits the axial motion of the launcher during recoil, and the mount (not shown) permits rotating the electromagnetic launcher 10 in azimuth. Choosing the location of the trunnion 16 near of the center of gravity of the launcher facilitates aiming and helps keep the electromagnetic launcher 10 stable as it is fired.

The electrical contacts 22 and 24 are mounted in the carriage 15 toward an axis of the trunnion 16. Thus, the electrical contacts 22 and 24 are located near the pivot point for the electromagnetic launcher 10, thereby providing for translation and rotation. Moreover, use of the electrical contacts 22 and 24 enables motion of the electromagnetic launcher 10 (such as during aiming or during recoil) without the need for flexure of the buswork. The electrical contacts 22 and 24 may be made from any material as desired that is suitable for conducting extremely high amounts of electrical current (on the order of around millions of Amperes or so). Given by way of non-limiting example, the electrical contacts 22 and 24 may be made of sintered carbon-copper electric brush material or silver. However, any acceptable electrical contact material may be used as desired for a particular application.

The electrical contacts 22 and 24 are electrically connected to a positive terminal and a negative terminal, respectively, of the electrical power supply 26. In an exemplary embodiment and given by way of non-limiting example, the electrical contacts 22 and 24 are connected to the electrical power supply 26 by electrical buswork, such as a laminated plate buswork used by those knowledgable in the art to reduce electromagnetic forces on the bus structure. Laminated plate buswork has been used in laboratory configurations, but because of the need to accommodate recoil, it has not been practical in fielded configurations. Because embodiments of the electromagnetic launcher 10 do not require the buswork to provide flexure for recoil, the use of laminated plate buswork in fielded applications is thereby enabled. Because laminated plate buswork is more easily cooled, such as by fluid channels using oil, water, air or other coolant, embodiments of the electromagnetic launcher 10 are well suited for use as fielded platforms. However, a cable buswork or any size electrical buswork made of any acceptable conductor, such as without limitation copper, may be used as desired for a particular application.

The power supply 26 provides a very large electrical current (on the order of around 1 million Amperes or so) of a short duration. Given by way of non-limiting examples, the power supply 26 may be provided in the form of a capacitive discharge device (that is, a bank of capacitors) or a pulsed alternator. A capacitor bank stores electrical energy via an electric field, and usually uses all of its energy for one launch event. Thus, a capacitor bank would entail recharging after each launch event. A pulsed alternator uses a low inductance generator to allow for rapid current rise and stores its energy in a high energy density flywheel. A pulsed alternator typically can store more energy per unit volume than a capacitor bank and typically can store enough energy for several consecutive launch events.

As will be discussed below, the electromagnetic launcher 10 is augmented only during early stages of a launch event, so, the amount of current supplied early in the launch event by the power supply 26 can be less than that for conventional electromagnetic launchers, thereby relaxing the need for fast rise times to high peak currents. Further, because the electromagnetic launcher 10 entails less total inductance than do conventional augmented electromagnetic launchers, the burden of high peak inductive energy stored is avoided. Thus, the electromagnetic launcher 10 is well-suited for use with rotating-machinery generators, such as pulsed alternators.

The augmentation conductors 28 and 30 extend from the trunnion 16 to the breech 14. The augmentation conductors 28 and 30 are electrically connected to the electrical contacts 22 and 24, respectively and the current cross-over connection 36. Thus, the length of the augmentation conductors 28 and 30 is a function of the location of the trunnion 16. The augmentation conductors 28 and 30 suitably may have a length of between around one-fourth to one-third the overall length of the electromagnetic launcher 10. A typical length of the augmentation conductors 28 and 30 may be around one fourth the overall length of the electromagnetic launcher 10. However, the augmentation conductors 28 and 30 may have any length as desired as determined by location of the trunnion 16.

As a result, the electromagnetic launcher 10 functions as a series-augmented electromagnetic launcher between the breech 14 and the trunnion 16. Thus, the electromagnetic launcher 10 can realize benefits of series augmentation (that is, additive magnetic fields resulting in greater expulsion forces with reduced current rise) in the early stages of the launch cycle during which the benefits of augmentation are realized. Moreover, providing for augmentation only in the early phases of the launch cycle can remove detriments associated with providing augmentation throughout the entire launch cycle (that is, avoiding higher peak power, peak energy transfer, and overall demands on the power supply). To that end, the electromagnetic launcher 10 can have lower inductance and place less load on the power supply 26 than do conventional series-augmented electromagnetic launchers. As a result, compared to conventional series-augmented electromagnetic launchers, less energy is stored in the magnetic field surrounding the electromagnetic launcher 10 as the projectile 38 exits the muzzle 18 and the magnetic field collapses. This reduced amount of energy stored can result in a smaller arc and less erosion due to vaporization of the main conductors 32 and 34 than that experienced in conventional series-augmented electromagnetic launchers.

The augmentation conductors 28 and 30 may be made of any suitable metal conductor that can withstand heat from Joule heating and that can withstand Lorentz forces involved with a launch event. In an exemplary embodiment, the augmentation conductors 28 and 30 suitably are made from 2"×4" copper rails. However, rails of other sizes that may be made from other metals may be used as desired for a particular application.

The augmentation conductors 28 and 30 are constrained from moving by the housing 12 and are insulated from other elements of the electromagnetic launcher 10 except for the intended current flow path from the electrical contacts 22 and 24 and the current cross-over connection 36. Portions 42 and 44 (on the order of approximately one feet to two feet or so as desired) of an outboard side of the augmentation conductors 28 and 30, respectively, are exposed to provide a sliding contact area for the electrical contacts 22 and 24. The exposed portions 42 and 44 extend from near the front end of the augmentation conductors 28 and 30, respectively, rearward to accommodate recoil and maintain electrical contact during launch. An insulating cover over the sliding contact area may be used for safety purposes, if desired.

The exposed portions 42 and 44 of the augmentation conductors 28 and 30 and the electrical contacts 22 and 24 work together to accommodate recoil during a launch event. The exposed portions 42 and 44 and the electrical contacts 22 and 24 can slide along each other, respectively, during recoil. The electrical contacts 22 and 24 are maintained in electrical contact with the exposed portions 42 and 44 by any means which will provide adequate contact force to maintain metal-to-metal contact, such as, given by way of non-limiting examples, springs, magnetostrictive materials, mechanical engagement such as wedges, or through Lorentz forces associated with the current flow.

The main conductors 32 and 34 extend from the breech 14 toward the muzzle 18. The main conductors 32 and 34 are electrically connected to the current cross-over connection 36. Thus, the main conductors 32 and 34 and the augmentation conductors 28 and 30 are electrically connected in series, respectively, via the current cross-over connection 36. As a result, the electromagnetic launcher 10 is a series augmented electromagnetic launcher during the early stages of the launch cycle, as described above. Therefore, as described above, this can result in a smaller arc and less erosion due to vaporization of the main conductors 32 and 34 than that experienced in conventional series-augmented electromagnetic launchers.

The main conductors 32 and 34 may be made of any suitable metal conductor that can withstand heat from Joule heating, that can withstand Lorentz forces involved with a launch event, and that can accommodate vaporization as the projectile 38 exits the muzzle 18. In an exemplary embodiment the augmentation conductors 28 and 30 suitably are made from 2"×4" copper rails. However, rails of other sizes that may be made from other metals may be used as desired for a particular application. The augmentation conductors 28 and 30 are constrained from moving by the housing 12 and are insulated from other elements of the electromagnetic launcher 10 except for the intended current flow path from the current cross-over connection 36 to the projectile armature.

The current cross-over connection 36 is disposed toward the breech 14. The current cross-over connection 36 electrically connects the augmentation conductors 28 and 30 with the main conductors 32 and 34, respectively. As a result, the electromagnetic launcher 10 is a series augmented electromagnetic launcher during the early stages of the launch cycle, as described above.

Because the current cross-over connection 36 is disposed toward the breech 14 and because the augmentation conductors 28 and 30 are located aft of the trunnion and the housing 12 is rotatable about the trunnion 16, the weight distribution of the electromagnetic launcher 10 can approximate that of a conventional propellant-based gun. Thus, the electromagnetic launcher 10 can be aimed similarly to a conventional propellant-based gun. Moreover, the swept volume of the electromagnetic launcher 10 aft of the trunnion can approximate that of a conventional propellant-based gun with smaller actuators and less force than that required for conventional electromagnetic launchers.

In an exemplary embodiment, the current cross-over connection 36 includes a cross-over connector 46 that electrically connects the augmentation conductor 28 and the main conductor 32 and a cross-over connector 48 that electrically connects the augmentation conductor 30 and the main conductor 34. The cross-over connectors 46 and 48 include conductor members 50 and 52. In an exemplary embodiment, the connectors 50 and 52 are generally planar conductors, such as plates. In such an arrangement, the connectors 50 are interleaved with the connectors 52. This arrangement reduces the electromagnetic forces among the connectors 50 and 52, but other arrangements or cable connectors can be used.

The projectile 38 can be any projectile suitable for launch from an electromagnetic launcher. Given by way of non-limiting example, the projectile 38 may be a rod, such as a tungsten rod, a ballistic projectile including a payload or warhead, or a guided projectile including electronic components. The projectile 38 is part of an electrically conductive launch package 54. As such, the projectile 38 is a flight body. The launch package 54 also includes an armature 56 through which electrical current flows from the main conductor 32 to the main conductor 34. Because augmentation occurs in early stages of the launch cycle, less material can be used in the armature 56 than is used in simple electromagnetic launchers. The armature 56 does not heat up as much as armatures used in simple electromagnetic launchers. This saves parasitic mass, thereby making more kinetic energy available for the projectile 38 itself. If desired, the flight package 54 may also include a sabot (not shown) that can be built around the projectile 38 to fill any gaps that may exist between the projectile 38 and the bore surfaces to provide stability during launch.

An exemplary embodiment operates as follows. During a launch event, electrical current I flows from the positive terminal of the power supply 26 through the electrical contact 22 which is free to slide on the augmentation conductor 28. The current I flows from the electrical contact 22 into the augmentation conductor 28 and flows in the augmentation conductor 28 toward the breech 14 and into the current cross-over connection 36. The current I then flows through the cross-over connector 46 to the main conductor 32 and then through the main conductor 32 toward the muzzle 18 until it reaches the armature 56. The current I then flows through the armature 56 to the main conductor 34. In the main conductor 34 the current I again flows toward the breech 14 (that is, in the same direction as the current flow in the augmentation conductor 28) and into the cross-over connection 36. The current I then flows through the cross-over connector 48 into the augmentation conductor 30. In the augmentation conductor 30, the current I flows toward the muzzle 18 (that is, in the same direction as in the main conductor 32) and into the electrical contact 24 from which the current I returns to the negative terminal of the power supply 26, thereby completing the circuit with the power supply 26.

In accordance with the right-hand rule, the created magnetic field circulates around each of the conductors 28, 30, 32, and 34. Because the electrical current I flows in an opposite direction along the conductors 28 and 32 than it does in the conductors 30 and 34, the net magnetic field between the main conductors 32 and 34 is directed vertically. Moreover, the current flow I is in the same direction (toward the breech 14) in the augmentation conductor 28 and the main conductor 32 on one side of the armature 56 and is in a same direction (toward the muzzle 18) in the augmentation conductor 30 and the main conductor 34 on the other side of the armature 56.

To that end, the magnetic field acting on the armature 56 is augmented. However, as described above, augmentation in the electromagnetic launcher 10 occurs only during early stages of the launch cycle. This is because the augmentation conductors 28 and 30 extend only between the trunnion 16 and the breech 14 (as opposed to conventional augmented electromagnetic launchers in which augmentation rails extend along the entire length of the electromagnetic launcher).

In combination with the electrical current flowing across the armature 56, a Lorentz force is produced which accelerates the projectile 38 along the main conductors 32 and 34. The projectile 38 exits the muzzle 18 at high velocities on the order of around several kilometers per second. The armature 56 and, if used, remnants of the sabot (not shown) are expelled with the projectile 38. Very little time (on the order of around 2-12 milliseconds or so) elapses from introduction of the current I to exiting of the projectile 38. Thus, the projectile 38 has travelled a long distance along its trajectory before any perceptible recoil motion occurs. Thus, FIG. 2 is not drawn to scale.

While a number of exemplary embodiments and aspects have been illustrated and discussed above, those of skill in the art will recognize certain modifications, permutations, additions, and sub-combinations thereof. It is therefore intended that the following appended claims and claims hereafter introduced are interpreted to include all such modifications, permutations, additions, and sub-combinations as are within their true spirit and scope.

What is claimed is:

1. An electromagnetic launcher comprising:

a trunnion having an axis;

a carriage supported on the trunnion;

an electromagnetic launcher housing having a breech and a muzzle, the electromagnetic launcher housing being slidably supported in the carriage;

first and second electrical contacts mounted in the carriage, the first and second contacts being electrically connectable to receive electrical power from an electrical power supply;

first and second augmentation conductors electrically connected to the first and second electrical contacts and located between the breech and the first and second electrical contacts when the electromagnetic launcher housing slides within the carriage to a recoiled position;

first and second main conductors between the breech and the muzzle; and a current cross-over connection, the current cross-over connection electrically connecting the first and second augmentation conductors with the first and second main conductors, respectively;

wherein, during launching of a projectile, the first and second augmentation conductors apply a force to the projectile that is directed toward the muzzle in a region between the breech and the first and second electrical contacts.

2. The electromagnetic launcher of claim 1, wherein the first and second electrical contacts are mounted through the carriage and the first and second augmentation conductors are engaged in slidable electrical contact with the first and second electrical contacts over a portion of a length of the first and second augmentation conductors.

3. The electromagnetic launcher of claim 1, wherein the current cross-over connection includes:

a first cross-over connector configured to electrically connect the first augmentation conductor and the first main conductor; and a second cross-over connector configured to electrically connect the second augmentation conductor and the second main conductor.

4. The electromagnetic launcher of claim 1, wherein the trunnion is located approximately at a center of gravity of the electromagnetic launcher.

5. The electromagnetic launcher of claim 4, wherein the center of gravity of the electromagnetic launcher is closer to the breech than to the muzzle.

6. An electromagnetic launcher comprising:

a trunnion having an axis;

a carriage supported on the trunnion;

an electromagnetic launcher housing having a breech and a muzzle, the electromagnetic launcher housing being slidably supported by the carriage;

first and second electrical contacts mounted in the carriage through the trunnion, the first and second contacts being electrically connectable to receive electrical power from an electrical power supply;

first and second augmentation conductors, the first and second augmentation conductors and the first and second electrical contacts being engaged in slidable electrical contact over a portion of a length of the first and second augmentation conductors;

first and second main conductors between the breech and the muzzle, the first and second main conductors being disposed inboard of the first and second augmentation conductors; and a current cross-over connection, the current cross-over connection electrically connecting the first and second augmentation conductors with the first and second main conductors, respectively;

wherein the electromagnetic launcher housing and the carriage are pivotable around the axis of the trunnion to change an elevation of the electromagnetic launcher without flexing electrical connections from the electrical power supply to the first and second electrical contacts.

7. The electromagnetic launcher of claim 6, wherein the current cross-over connection includes:

a first cross-over connector configured to electrically connect the first augmentation conductor and the first main conductor; and a second cross-over connector configured to electrically connect the second augmentation conductor and the second main conductor.

8. The electromagnetic launcher of claim 6, wherein, during launching of a projectile, the first and second augmentation conductors generate a magnetic field in the same direction as the first and second main conductors to augment a force applied to the projectile between the breech and the first and second electrical contacts.

9. The electromagnetic launcher of claim 6, wherein conductive elements used to couple the first and second electrical contacts to the electrical power supply are not flexed by recoil of the electromagnetic launcher housing during launching of a projectile and are not flexed by pivoting of the electromagnetic launcher housing and the carriage around the axis of the trunnion.

10. An electromagnetic launcher comprising:

a trunnion having an axis;

a carriage supported on the trunnion;

an electromagnetic launcher housing having a breech and a muzzle, the electromagnetic launcher housing being slidably supported in the carriage;

first and second electrical contacts mounted in the carriage, the first and second contacts being electrically connectable to receive electrical power from an electrical power supply;

first and second augmentation conductors disposed aft of the trunnion, the first and second augmentation conductors being electrically connected to the first and second electrical contacts;

first and second main conductors between the breech and the muzzle, the first and second main conductors being disposed inboard of the first and second augmentation conductors; and a current cross-over connection disposed sufficiently near the breech to cause a center of gravity of the electromagnetic launcher to be closer to the breech than to the muzzle, the current cross-over connection electrically connecting the first and second augmentation conductors with the first and second main conductors, respectively, the current cross-over connection including:

a first cross-over connector configured to electrically connect the first augmentation conductor and the first main conductor; and a second cross-over connector configured to electrically connect the second augmentation conductor and the second main conductor.

11. The electromagnetic launcher of claim 10, wherein the first and second electrical contacts and the first and second augmentation conductors are engaged in slidable electrical contact over a portion of a length of the first and second augmentation conductors.

12. The electromagnetic launcher of claim 10, wherein the first and second cross-over connectors include first and second pluralities of conductor members.

13. The electromagnetic launcher of claim 12, wherein conductor members of the first plurality of conductor members are interleaved with conductor members of the second plurality of conductor members.

14. The electromagnetic launcher of claim 10, wherein the first and second augmentation conductors generate a force directed toward the muzzle in a region between the breech and the first and second electrical contacts during launch of a projectile, and wherein the first and second augmentation conductors extend between about one quarter and one third of a length of the first and second main conductors.

15. An electromagnetic launcher system comprising:

an electrical power supply;

a trunnion having an axis;

a carriage supported by the trunnion;

an electromagnetic launcher housing having a breech and a muzzle, the electromagnetic launcher housing being slidably supported by the carriage;

first and second electrical contacts mounted in the carriage near the axis and coupled through the carriage to laminated plate buswork to receive electrical power from the electrical power supply via the laminated plate buswork;

first and second augmentation conductors, the first and second augmentation conductors being electrically connected to the first and second electrical contacts, wherein the first and second augmentation conductors move relative to the first and second electrical contacts during recoil of the electromagnetic launcher housing and during pivoting of the electromagnetic launcher housing around the axis of the trunnion;

first and second main conductors that extend between the breech and the muzzle, the first and second main conductors having a length greater than a length of the first and second augmentation conductors, respectively; and current cross-over connections electrically connecting the first and second augmentation conductors with the first and second main conductors, respectively, wherein the current cross-over connections are located to cause the first and second augmentation conductors, during launching of a projectile, to generate an augmentation force that augments a force generated by the first and second main conductors in a first region that is between the breech and the first and second electrical contacts, wherein the first and second augmentation conductors do not generate the augmentation force in a second region that is between the first and second electrical contacts and the muzzle.

16. The electromagnetic launcher of claim 15, wherein the electrical power supply includes a pulsed power supply.

17. The electromagnetic launcher of claim 16, wherein the pulsed power supply includes a power supply chosen from a capacitive discharge power supply and a pulsed alternator.

18. The electromagnetic launcher of claim 15, wherein the electrical power supply and the first and second electrical contacts are electrically connected via the laminated plate buswork.

19. The electromagnetic launcher of claim 15, wherein the first and second electrical contacts and the first and second augmentation conductors are engaged in slidable electrical contact over a portion of a length of the first and second augmentation conductors.

20. The electromagnetic launcher of claim 15, wherein the current cross-over connections include:

a first cross-over connector configured to electrically connect the first augmentation conductor and the first main conductor; and a second cross-over connector configured to electrically connect the second augmentation conductor and the second main conductor.

21. The electromagnetic launcher of claim 20, wherein the first and second cross-over connectors include first and second pluralities of conductor members.

22. The electromagnetic launcher of claim 21, wherein conductor members of the first plurality of conductor members are interleaved with conductor members of the second plurality of conductor members.

23. The electromagnetic launcher of claim 15, wherein the first and second main conductors are disposed inboard of the first and second augmentation conductors.

* * * * *